US007530183B2

(12) United States Patent
Munns

(10) Patent No.: US 7,530,183 B2
(45) Date of Patent: May 12, 2009

(54) FOLD-OVER THERMAL LAMINATE FOR FOOTWEAR

(75) Inventor: Jon Munns, Gilroy, CA (US)

(73) Assignee: Fox Racing, Inc., Morgan Hill, CA (US)

( * ) Notice: Subject to any disclaimer, the term of this patent is extended or adjusted under 35 U.S.C. 154(b) by 434 days.

(21) Appl. No.: 11/458,068

(22) Filed: Jul. 17, 2006

(65) Prior Publication Data

US 2007/0118975 A1 May 31, 2007

Related U.S. Application Data

(60) Provisional application No. 60/735,302, filed on Nov. 10, 2005.

(51) Int. Cl.
*A43B 13/22* (2006.01)
*A43B 5/00* (2006.01)

(52) U.S. Cl. ..... 36/131; 36/45; 36/113

(58) Field of Classification Search ..... 36/45, 36/131, 70 R, 72 R, 109, 113
See application file for complete search history.

(56) References Cited

U.S. PATENT DOCUMENTS

| | | | | | |
|---|---|---|---|---|---|
| 808,666 | A | | 1/1906 | Linthicum | |
| 1,332,472 | A | | 3/1920 | Shibley | |
| 1,478,467 | A | * | 12/1923 | Binns | 36/45 |
| 1,478,468 | A | * | 12/1923 | Binns et al. | 36/1 |
| 1,621,342 | A | * | 3/1927 | Webber | 36/72 R |
| 1,660,046 | A | * | 2/1928 | Phillips | 36/45 |
| 1,794,035 | A | * | 2/1931 | Schonfeld | 36/72 R |
| 1,851,629 | A | * | 3/1932 | Herzstein | 36/45 |
| 2,053,813 | A | | 9/1936 | Brennan | |
| 2,097,200 | A | | 10/1937 | Menutole | |
| 2,427,459 | A | * | 9/1947 | Jastrzomb | 36/1 |
| 2,642,678 | A | * | 6/1953 | Fula | 36/72 R |
| 2,779,109 | A | * | 1/1957 | Pizzo et al. | 36/70 R |
| 3,091,871 | A | * | 6/1963 | Tronche | 36/72 R |
| 3,744,158 | A | | 7/1973 | Walker | |
| 3,783,534 | A | | 1/1974 | Phillips et al. | |

(Continued)

FOREIGN PATENT DOCUMENTS

| | | |
|---|---|---|
| EP | 0986969 | 3/2000 |

(Continued)

OTHER PUBLICATIONS

U.S. Office Action dated Oct. 23, 2008 issued for related U.S. Appl. No. 11/458,027, filed Jul. 17, 2006, 12 pages.

(Continued)

*Primary Examiner*—Marie Patterson
(74) *Attorney, Agent, or Firm*—Ganz Law, P.C.

(57) ABSTRACT

Protective footwear, such as a motorcycle or motocross boot, having a molded top gasket and/or a fold-over thermal laminate. The molded top gasket may be a substantially annular unitary piece or multi-piece construction of an elastomeric material, such as rubber, that snugly wraps around the wearer's lower leg or ankle when the footwear is worn. The fold-over thermal laminate is a piece of thermally resistant material on the outer surface of the footwear upper that extends over a portion of the rim and into the inside of the upper. One or more optional control pads also may be placed on the exterior surface of the thermal laminate.

14 Claims, 6 Drawing Sheets

U.S. PATENT DOCUMENTS

| | | | | | |
|---|---|---|---|---|---|
| 3,906,645 | A | | 9/1975 | Heckel | |
| 4,062,133 | A | * | 12/1977 | McGee et al. | 36/131 |
| 4,095,356 | A | | 6/1978 | Robran et al. | |
| 4,267,651 | A | * | 5/1981 | Albano | 36/131 |
| 4,542,597 | A | | 9/1985 | Baptista et al. | |
| 4,563,825 | A | | 1/1986 | Tesser | |
| 4,587,749 | A | | 5/1986 | Berlese | |
| 4,670,946 | A | | 6/1987 | Olivieri | |
| 4,693,021 | A | * | 9/1987 | Mazzarolo | 36/131 |
| 4,882,858 | A | * | 11/1989 | Signori | 36/131 |
| 5,109,613 | A | | 5/1992 | Van Dyke | |
| 5,234,230 | A | | 8/1993 | Crane et al. | |
| 5,438,769 | A | | 8/1995 | Mazzarolo | |
| 5,495,683 | A | | 3/1996 | Miotto et al. | |
| 5,678,833 | A | | 10/1997 | Olson et al. | |
| 5,720,084 | A | | 2/1998 | Chen | |
| 5,842,293 | A | | 12/1998 | Young | |
| 5,884,370 | A | | 3/1999 | Bergamin | |
| 6,691,434 | B1 | | 2/2004 | Couturier | |
| 6,826,853 | B1 | * | 12/2004 | Zanatta | 36/131 |
| 2004/0226195 | A1 | | 11/2004 | Martinez | |
| 2007/0101615 | A1 | | 5/2007 | Munns | |
| 2007/0101616 | A1 | | 5/2007 | Munns | |

FOREIGN PATENT DOCUMENTS

| | | |
|---|---|---|
| GB | 2045598 | 11/1980 |
| JP | 03184501 | 8/1991 |

OTHER PUBLICATIONS

30 Years of Maximum Motocross—1974-2004—Fox—Product Catalog; Copyright 2003; Fox Racing, Inc. Morgan Hill, California; pp. 14-18, and 77 (7 pages total).

Fox MX Spring Additions 2005—Product Catalog; Copyright 2005; Fox Racing, Inc. Morgan Hill, California; p. 40 (2 pages total).

Fox 2006—Product Catalog; Copyright 2005; Fox Racing, Inc. Morgan Hill, California; pp. 49, 75, and 84 (4 pages total).

* cited by examiner

FOLD-OVER THERMAL LAMINATE FOR FOOTWEAR

RELATED APPLICATIONS

This application claims priority to U.S. Provisional Patent Application No. 60/735,302, filed Nov. 10, 2005 by Jon Munns, entitled ARTICLE OF FOOTWEAR and is related to co-pending applications U.S. application Ser. No. 11/458,027, filed Jul. 17, 2006, by Jon Munns entitled MOLDED GASKET FOR FOOTWEAR and U.S. application Ser. No. 11/458,055, filed Jul. 17, 2006, by Jon Munns entitled INTEGRATED BUCKLE STRAP RECEIVER FOR FOOTWEAR, the contents of which are each hereby incorporated by reference as if recited in full herein for all purposes.

BACKGROUND

Millions of people around the world use motorcycles not just for transportation, but for recreational activities such as touring and vacationing, off-road exploration, and racing. Motorcycle racing is a multi-billion dollar industry just in North America. Amateur and professional racers compete in thousands of races every year all over Canada, Mexico, and the United States. For example, the American Motorcycle Association® (AMA) organizes racing competitions in six different categories: superbike, flat track, supermoto, motocross, supercross, and hillclimb. Motorcycle riding competitions also feature prominently in extreme sports competitions, such as the X Games® or the Dew Sports Action Tour™ competitions. Additionally, motorcycles and motocross have inspired or melded with other types of vehicles to create new forms of all-terrain vehicle (ATV) recreation, including quad racing, competitive snowmobile racing, and bicycle motocross (BMX).

Protective gear is a critical component for amateur and professional motorcycle enthusiasts, and manufacturers often tailor such equipment for specific uses. Off-road motorcycle riding and racing present unique challenges for protective riding gear. Not only must the equipment protect riders in the case of a fall, it must function in the face of unique hazards not seen in road riding or track racing. In all types of off-road motorcycle riding and racing, riders often face treacherous riding conditions while traveling over dirt, sand, mud, and snow. Off-road riders often must negotiate around trees and stumps, boulders, brush, and other terrain features. Not only must a rider's protective gear protect him from such risks of injury, that equipment should be able to structurally withstand being struck by such objects without failing. In wet or snowy conditions, riders often become covered in mud, which can interfere with attachment mechanisms on protective equipment.

The legs of an off-road rider in particular face a variety of hazards presented by flying objects (e.g., rocks, clumps of mud, sand, and branches), kicked up by the rider's own vehicle and by other riders, as well as terrain features. Even on relatively smooth dirt tracks, the risk of lower leg or foot injury for flying objects may be substantial. Additionally, motorcycle riders expect their boots to protect them from hazards presented by the bikes they ride or those of other riders. In the case of a fall or a collision, a rider's leg may become pinned under the motorcycle, and even while riding, heat from engine and exhaust components presents a burn risk to an unprotected rider.

In view of the forgoing, there is an ever-present need for improved protective footwear for motorcycle and other off-road motorsports that protects a rider's lower legs and feet against reasonably anticipated risks and hazards that the rider might face. Additionally, there is an ever-present need to improve the construction of such protective footwear to render it more effective, durable, and to reduce production costs.

Boot Gaskets

Many motorcycle boots, including motocross boots, include a top gasket on the upper intended to fit snugly against the wearer's leg. This gasket usually fits around the top opening of the boot that surrounds a portion of the rider's calf. The gasket provides a seal against dirt, rocks, mud, vegetation, and other objects being forced inside the boot while the wearer is riding a motorcycle. The gasket of a motocross boot usually is designed to be flexible and elastic to accommodate other protective gear a rider wears, such as knee guards and shin guards.

Top gaskets of prior art motocross boots typically are constructed from natural or synthetic leather that is gathered around and stitched into the top of the boot. Thus, traditional gaskets are based on a substantially two-dimensional material (a flat strip of leather) that is gathered and formed into a three-dimensional shape. These traditional gaskets can be quite bulky and often wear out quickly because the top of the boot is exposed to the environmental hazards described above and usually experience a great amount of wear and tear during use. Additionally, making such top gaskets can be a labor-intensive effort requiring gathering and stitching of leather around a specific area of the boot. Some attempts to provide gasket-like elements to the top of motorcycle boots include the following.

U.S. Pat. No. 4,267,651 discloses a motorcycle boot with a mechanism for removing air from inside the boot. Part of that system is a "means for hermetically sealing" based on an insertable "small shoe" (7) that fits into an outer impact shield of a boot, similar to the type of system commonly seen in ski boots. The insertable shoe part is "preferably made of a flexible synthetic material" and includes a collar (7a). This patent does not describe integrating the small shoe's collar as a top gasket on the top of a boot, and does not disclose specific materials or manufacturing processes for making the collar.

U.S. Pat. No. 4,563,825 discloses a boot for sportswear, such as motorcycling and skiing. The boot includes a collar (134) folded outwardly to form an annular chamber that is then wrapped around the wearer's leg. However, this patent—like the '651 patent above—does not disclose specific materials or manufacturing processes for making the collar.

U.S. Pat. No. 4,095,356 describes a ski boot with an inner liner that "may extend over the top of the upper impact shield assembly" of the boot (indicated as ref. no. 48 in FIGS. 1 and 2). No specific materials or manufacturing processes for making the inner liner are mentioned.

Unfortunately, these references have not provided an easily manufactured solution that is effective at helping seal the top of a motorcycle boot when worn.

Thermal Laminates

Many prior art motocross boots include a thermal laminate, also known as a "burn guard", placed on the outer surface of a boot upper in a manner intended to help protect against heat that emanates from a motor vehicle's engine and exhaust system. In the absence of a thermal laminate, there is a greater risk that heat could damage the boots and other equipment a rider wears or even pose a burn hazard to the rider. Traditional thermal laminates usually are made from a layer of flexible, heat resistant natural or synthetic leather stitched to the outer surface of the boot. The top edge of the thermal laminate usually is stitched to the leather top gasket surrounding the top of the boot. The thermal laminate typically extends down the outer surface of the boot upper to protect the inside portion of the boot and rider's lower leg that straddles the motorcycle engine. Unfortunately, in traditional thermal laminates, a leading edge of the top gasket extends above the thermal laminate and remains exposed to the environment. This leading edge of the top gasket, and the interface between the thermal laminate and the gasket, often suffer a great amount of wear and tear during use due to this exposure, which not only compromises the ability of the top gasket to function properly, but may advance the degradation of other boot components as well.

Another problem with traditional thermal laminates is that they are disposed on a portion of a boot that a rider may place in contact with portions of the motorcycle (or other motor vehicle) to exert force and control over the motion of the motorcycle or to better grip the motorcycle. Unfortunately, many traditional thermal laminates made of leather tend not to grip well against hard or slippery surfaces of a motorcycle, which does not facilitate rider control over the motorcycle.

SUMMARY OF THE INVENTION

In some embodiments, the inventive subject matter overcomes problems in the prior art by providing a molded top gasket that is easy to manufacture and assemble, and that provides a good seal around a wearer's leg. The gasket also may be manufactured at a relatively low cost because its manufacturing is less labor-intensive than traditional gaskets.

In other embodiments, the inventive subject matter also overcomes problems in the prior art by providing a thermal laminate assembly that protects at least a portion of the top gasket vulnerable to direct damage. It also provides thermal laminate assemblies with control pads that may frictionally engage the motorcycle or other vehicle to enhance rider control.

These and other embodiments are described in more detail in the following detailed description and the figures. The foregoing is not intended to be an exhaustive list of embodiments and features of the inventive subject matter. Persons skilled in the art are capable of appreciating other embodiments and features from the following detailed description in conjunction with the drawings.

DETAILED DESCRIPTION

Figure 1:
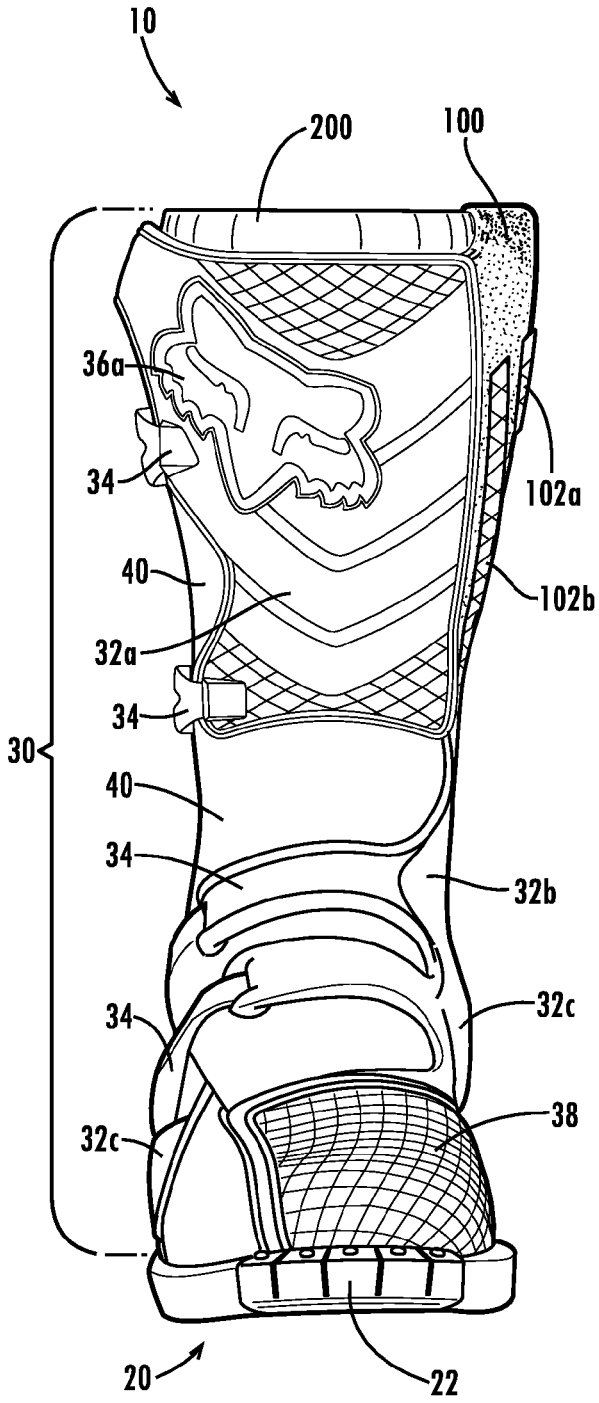
FIG. 1 is a front view of one embodiment of a motocross boot illustrating a representative embodiment of the molded top gasket and one embodiment of the fold-over thermal laminate according to the inventive subject matter disclosed herein. This particular motocross boot is intended for the right foot of a wearer.
Figure 2:
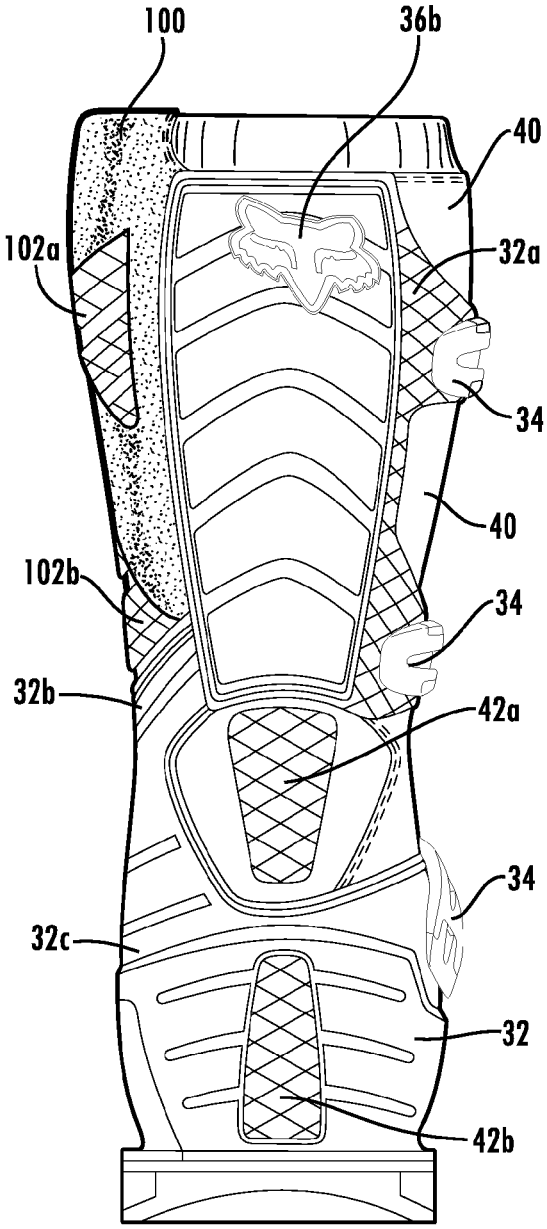
FIG. 2 is a rear view of the boot shown in FIG. 1.
Figure 3:
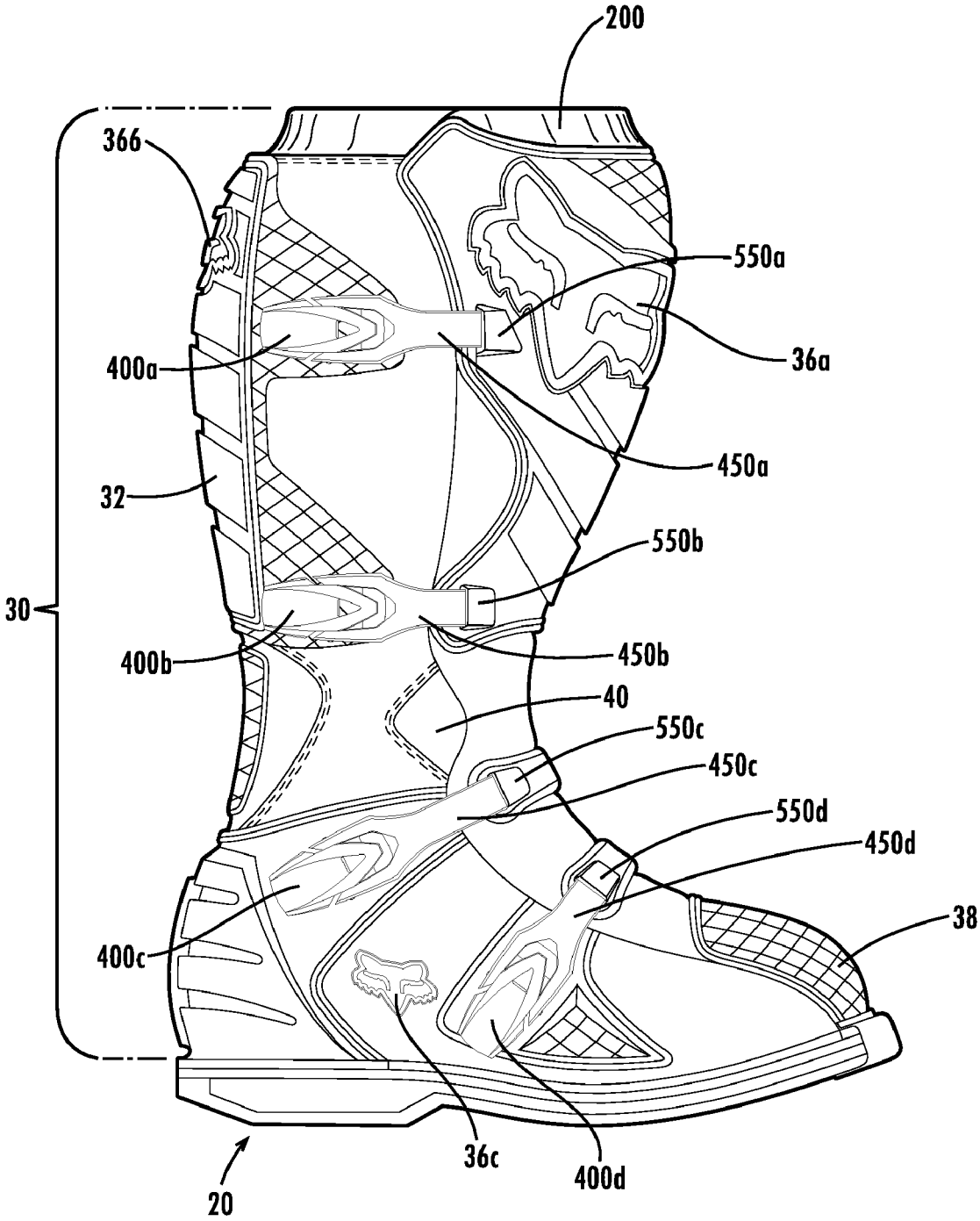
FIG. 3 is a right side view of the boot shown in FIG. 1.

Representative embodiments of the inventive subject matter are shown in FIGS. 1 through 8, wherein similar features share common reference numerals.

An Exemplary Motocross Boot

FIGS. 1-4 illustrate a motocross boot utilizing the molded top gasket, fold-over thermal laminate, and other inventive features. While the following description relates to the illustrated boot, the molded top gasket (and other inventive features) may be embodied in protective footwear for other uses, including (but not limited to) supercross, snowmobile racing or riding, motocross freestyle and trick riding, or recreational off-road motorcycle, quad racer, or other ATV riding.

The illustrated motocross boot 10 has a sole unit 20 and an upper 30. The sole unit 20 and upper 30 may be disposed on: a front-rear axis running between the toe of the boot and the heel (which may be considered an X-axis); a top-bottom axis running between top of the boot that circles the calf of the wearer just below the knee and the bottom of the boot (which may be considered a Y-axis); and a medial-lateral axis running between the left side (inside) and right side (outside) of the boot (which may be considered a Z-axis).

The sole unit 20 provides a platform for the foot and may be composed of any material providing suitable stiffness and protection, including plastics, rubbers (including cured or vulcanized rubbers), natural or synthetic compressed leather, or combinations thereof, including laminated sole units having layers of different materials. Optionally, a metal plate (not shown) may be sandwiched within layers of the sole unit, a layer of compressible sponge or foam material (such as spongy ethyl vinyl acetate) can be added within the sole, and/or a metal toe plate 22 may be mounted on the front toe area of the sole. This toe plate offers additional protection and facilitates shifting and other controls of the motorcycle while riding.

The upper 30 is attached to the sole unit and extends upwardly therefrom and wraps around at least a portion of the lower leg of a wear. It has an opening 31 for receiving a wearer's foot when the boot 10 is secured to a wearer's leg. The boot 10 typically is sized to receive the wearer's foot, ankle, and at least a portion of the wearer's lower leg. The upper 30 includes a top edge portion that defines both the opening 31 and a transverse plane that is substantially perpendicular to the Z-axis of the boot 10. This transverse plane also is substantially parallel to the X-axis and Y-axis of the boot 10. When the boot is worn, this transverse plane intersects a portion of the wearer's lower leg through the tibia and fibula that is inferior to the knee joint and superior to the ankle. In particular embodiments, this transverse plane intersects the wearer's lower leg through the superior half of the tibia and fibula.

The upper 30 may include several different components that serve functional or protective needs of a wearer: an impact shield 32, an attachment system 34, optional design indicia 36, a toe/instep control area 38 for contacting the motorcycle (e.g., controlling the shift lever), a foot/leg encasement 40, a protective heel plate 42, a thermal laminate 100, and a top gasket 200. Any suitable material that provides the minimum physical characteristics may be used to construct each part of the upper; the following descriptions of suitable materials are presented for exemplary purposes only and should not be interpreted as providing an exhaustive range of suitable materials. Combinations of these materials may be used in constructing various parts of the motorcycle boot as well.

The impact shield functions as a protective layer or shield that reduces the risk of a wearer suffering injury if he is struck by a flying object, collides with another rider, accidentally falls of a motorcycle, or suffers some other trauma to the legs. The impact shield need not cover or surround the entire upper, or even a major portion of the upper, and while the impact shield forms the outer layer of the upper in many embodiments, the shield alternatively may form a different layer of the upper. Suitable materials for constructing the impact shield include: hard yet flexible thermoplastics, rubbers, elastomers, and other polymers such as PE (polyethylene), HDPE (high density polyethylene), high impact polypropylene, TPU (thermoplastic urethane), Ortholite™ Rubthane™, and different nylon formulations; metals or alloys, such as aluminum, stainless steel, steel, and tungsten; or woven fabrics (including blended fabrics), laminates, or composites, such as Kevlar®, ballistic nylon, carbon fiber, and fiberglass. In selected embodiments, a dual-density or dual-durometer shield is constructed from at least two different materials having different densities or hardness ratings. For example, the shin guard portion of the shield (covering the shin of the wearer) may be made from a harder, denser material like TPU while portions intended for control or manipulation of the motorcycle may be made from a softer, less dense material like Rubthane.

The attachment system secures the footwear to the wearer's foot and at least a portion of the wearer's lower leg above the ankle. Suitable materials for constructing the buckles and anchors of the attachment system include: rigid thermoplastics, such as PVC (polyvinyl chloride) or PS (polystyrene), nylons, or TPU; and metals or alloys, such as aluminum, steel, tungsten, or nickel. Straps of the attachment system may be constructed from thermoplastics such as PE (polyethylene), HDPE (high density polyethylene), LDPE (low density polyethylene), or high impact polypropylene; and woven fabrics (including blended fabrics) or flexible laminates and composites, such as cotton, rayon, nylon, spandex, Kevlar®, polyester, or rayon.

Design indica are intended to provide an aesthetic look to the finished product, create a brand for the product, and/or identify the source of the product in the minds of consumers. Suitable materials for such indicia include: rigid thermoplastics, such as PVC (polyvinyl chloride), PS (polystyrene), fine mold TPU (thermoplastic urethane), and metals or alloys, such as aluminum, steel, tungsten, or nickel. In selected embodiments, the indicia are partially or completely chrome plated.

The toe/instep control area provides a moderate to high friction surface in the front area of the boot to facilitate operation and control of the motorcycle (or other motor vehicle), and the toe/instep control area may be softer than the underlying base material. Suitable materials for manufacturing the to/instep control area include: elastomers, rubbers, and thermoplastics such as LDPE (low density polyethylene), neoprene, polychloroprene latexes, chlorosulfonated polyethylene synthetic rubber, ethylene octene copolymers, and EPDM (Ethylene Propylene Diene Monomer).

The foot/leg encasement typically forms the innermost layer of the upper that encloses the wearer's foot and leg. It may include cushioning to provide a softer, more comfortable, adjustable fit. The encasement may be made from natural or synthetic fabrics or technical textiles (including blends and treated or coated fabrics and materials), such as natural or synthetic leather, polyethylene coated leather, cotton, polyester, nylon, rayon, spandex and other polyurethane-based elastane textiles, flexible polyurethane foams, cotton batting, latex foam, Biofoam™, and impact-reducing gels. In selected embodiments, the encasement includes air pockets or chambers to further reduce shocks and impacts.

The heel plate is intended to provide an additional layer of protection (in addition to the impact shield) over the heel and lower leg area, such as over the Achilles tendon. Suitable materials for the heel plate include: rigid thermoplastics, such as PVC (polyvinyl chloride), PS (polystyrene), TPU (thermoplastic urethane); and metals or alloys, such as aluminum, stainless steel, tungsten, and nickel.

The thermal laminate is a protective layer and thermal insulator intended to protect the boot and the wearer from heat-related damage or injury. Suitable materials for the thermal laminate include: natural or synthetic leathers, such as suede leather; woven natural or synthetic fabrics (including blended, coated, or treated fabrics) including ceramic textiles and textiles containing carbon fiber or aramid (aromatic polyamide), meta-aramid, or para-aramid fibers, such as Nomex® or Kevlar®; natural and synthetic rubbers and elastomers such as: polychloroprene, chlorosulfonated polyethylene, perfluoroelastomers, ethylene octene copolymers, EPDM, polychloroprene latexes, and other polyolefins; or plastics and other polymers, such as mylar, PU, and LDPE.

The top gasket is intended to provide a seal that at least partially separates the inside of the boot from the external environment when the boot is worn. The gasket is intended to provide a barrier protecting the interior of the boot against substances or objects (e.g., dirt, sand, mud, snow, rocks, debris). Suitable commercially available elastomeric materials include natural or synthetic rubbers, such as neoprene, latex rubber, silicone rubber, and Rubthane.

Mixtures of the materials mentioned herein also may be used including (but not limited to) fiberglass reinforced nylons or carbon fiber and Kevlar® blends. Any of these materials may be altered, coated, or otherwise treated with an additive, such as a pigment or coloring agent; emulsifiers; reinforcing agents; antimicrobial agents; flame retardants; or thermal insulators. Additionally, the shape or surface of any boot component may be altered for aesthetic or functional purposes, including (but not limited to) molding, shaping, texturing, scoring, painting, printing, stamping, pressing, and embroidering.

The impact shield 32 is a hard protective shell that preferably still provides sufficient flexibility for a wearer to put on and remove the boot. The following describes a typical construction for a shield in a motocross boot.

The top portion of the impact shield 32*a* may substantially surround the entire upper portion of the wearer's lower leg (e.g., the portion of the lower leg where the superior portions of the calf muscles attach to the superior portions of the tibia and fibula adjacent to, but inferior to, the lower portions of the knee joint and patella region).

Only some small areas over medial and medial-anterior sections of this region of the wearer's lower leg are not covered by the hard plastic impact shield, although (as described below) these areas are still protected by the leg/foot encasement of the boot. The conformations and arrangements of the shield and encasement are designed to provide lateral strength and stability (along the Z-axis) while still allowing sufficient flexion of the foot (along the X-axis). The top-most buckle strap 450*a* may be coupled to the top portion of the impact shield 32*a* via buckle strap receiver 550*a*.

The middle portion 32*b* of the impact shield 32 may substantially cover the anterior, posterior, and lateral sides of the wearer's lower leg (FIGS. 1, 2, and 4) to an area just superior to the wearer's ankle. In the illustrated embodiment, the impact shield 32 only partially extends into and covers areas corresponding to the lateral side of the wearer's lower leg and upper ankle (i.e., the inferior portions of the tibia and fibula where these bones interact with the superior extensions of the ankle bones). The middle buckle strap 450*b* may be coupled to this middle portion of the impact shield via buckle strap receiver 550*b*.

The lower portion 32*c* of the impact shield 32 may substantially surround the medial and lateral sides of the wearer's foot and ankle (FIG. 4) as well as the wearer's heel and toes (FIGS. 1-4). The medial side of the lower portion of the impact shield may substantially cover the heel, ankle, and toes (FIG. 3), but the area that would otherwise cover the wearer's lateral side of the upper ankle/lower leg (where the inferior ends of the tibia and fibula interact with the superior extensions of the ankle bones), and superior top of the foot may be left open. The lower-most buckle straps 450*c* and 450*d* may coupled to this lower portion of the impact shield via buckle strap receivers 550*c* and 550*d*.

The gaps or open areas of the boot upper not covered by the impact shield typically are not as prone to environmental injury (from flying objects, obstructions, contact with the motorcycle, and the like) while a wearer is riding a motorcycle. Leaving these areas of the boot upper open—rather than being covered by additional portions of the impact shield—facilitates flexion of the foot during riding and reduces excess weight of the boot. Foot and leg movement may be an important part of controlling motorcycle operation, so this balance between providing hard, but less flexible, protective surfaces and flexible, but less protective, areas that facilitate foot movement may be an important consideration in designing any protective motocross boot. Additionally, excess weight of any protective gear, including motocross boots, may adversely affect a wearer's performance during use, particularly during strenuous competitive or recreational activities such as motocross racing or off-road motorcycle riding. Accordingly, in view of the forgoing, person skilled in the art may vary areas of coverage to meet particular design considerations.

The attachment system 34 includes buckle straps 450*a-d*, buckles 400*a-d*, and buckle strap receivers 550*a-d*. In the illustrated motocross boot 10 (FIGS. 1-4), the attachment system 34 includes four sets of these components, though other embodiments may include a different number of component sets, such as two, three, five, six, seven, or more sets of buckles, buckle straps, and buckle strap receivers. Additionally, locating the components of the attachment system on the lateral side of the boot provides the advantage of reducing the risks of damage during use. The lateral side of the boot faces away from the motorcycle during use, thus avoiding risks of damage from the rider accidentally striking the motorcycle with the boot and damaging the attachment system or causing a buckle to break or disengage.

Referring to just one set of components, buckle strap receiver 550*a* may be coupled to the upper portion 32*a* of the impact shield. This coupling may be accomplished in a variety of ways. In selected embodiments, the buckle strap receiver is co-molded with the impact shield and essentially forms an extension of the impact shield. In other embodiments, the buckle strap receiver is molded, formed, constructed, or otherwise manufactured as a separate piece that is mounted onto the hard plastic impact shield by mechanical or chemical bonding, such as riveting, gluing, or bonding. Buckle strap receiver 550*a* receives and retains buckle strap 450*a*. The interaction between the buckle strap receiver 550*a* and buckle strap 450*a* may be adjustable to meet the desired fit of a wearer and buckle strap 450*a* may be completely disengaged from buckle strap receiver 550*a*, such as when the boot is being put on or taken off a wearer. Buckle strap 450*a* is coupled to buckle 400*a*. Buckle strap 450*a* may be co-molded with all or part of buckle 400*a*, or it may be attached to buckle 400*a* mounted by mechanical or chemical bonding, such as riveting, using mounting screws or nuts and bolts, gluing, or bonding. The buckle 400*a* attaches to a buckle anchor (not shown) in an engageable/disengageble manner. The wearer may attach the boot to her body by inserting her foot into the encasement (described below), adjusting the lengths of the buckle straps between the buckles and buckle strap receivers, and attaching the buckles securely to the buckle anchors. Additional descriptions of an attachment system may be found in U.S. application Ser. No. 118458055, filed Jul. 17, 2006, by Jon Munns entitled INTEGRATED BUCKLE STRAP RECEIVER FOR FOOTWEAR.

Indicia 36*a-c* are aesthetic designs made of hard plastic, metal, or other materials. These indicia may provide additional protection to the wearer, but are primarily intended to identify the product through recognizable shapes, symbols, colors, or other sensory cues. As just one example, the fox head indicia 36*a-c* used on the illustrated embodiment of the boot (FIGS. 1-6) are the trademarks of Fox Racing, Inc. (Morgan Hill, Calif.).

The toe/instep control area 38 may be a layer of lower density plastic or polymers on the outer surface of the underlying hard plastic impact shield 32*c* which offers greater friction for a better grip while interacting with various surfaces and controls on the motorcycle, such as portions of the frame, foot-operated shifting levers, and foot pegs. Optionally, the toe/instep may be textured or contoured to enhance such interactions.

Encasement 40 typically is located inside the impact shield 32 and encases the wearer's foot and lower leg. The encasement may be constructed to enhance the wearer's comfort during use while still offering at least a minimal degree of protection against the risks of impact injuries caused by falling, collisions, flying rocks or other objects, or environmental obstructions. As just one example, encasement 40 may be constructed from an outer layer of heavy synthetic or natural leather and an inner layer of spandex or Lycra® that both sandwich a layer of compressible foam.

Heel plate 42*a-b* typically is a flat protective member mounted on the outside of the upper, which provides additional protection to the heel, ankle, and inferior posterior portions of the wearer's lower leg.

Molded Top Gasket

Figure 5:
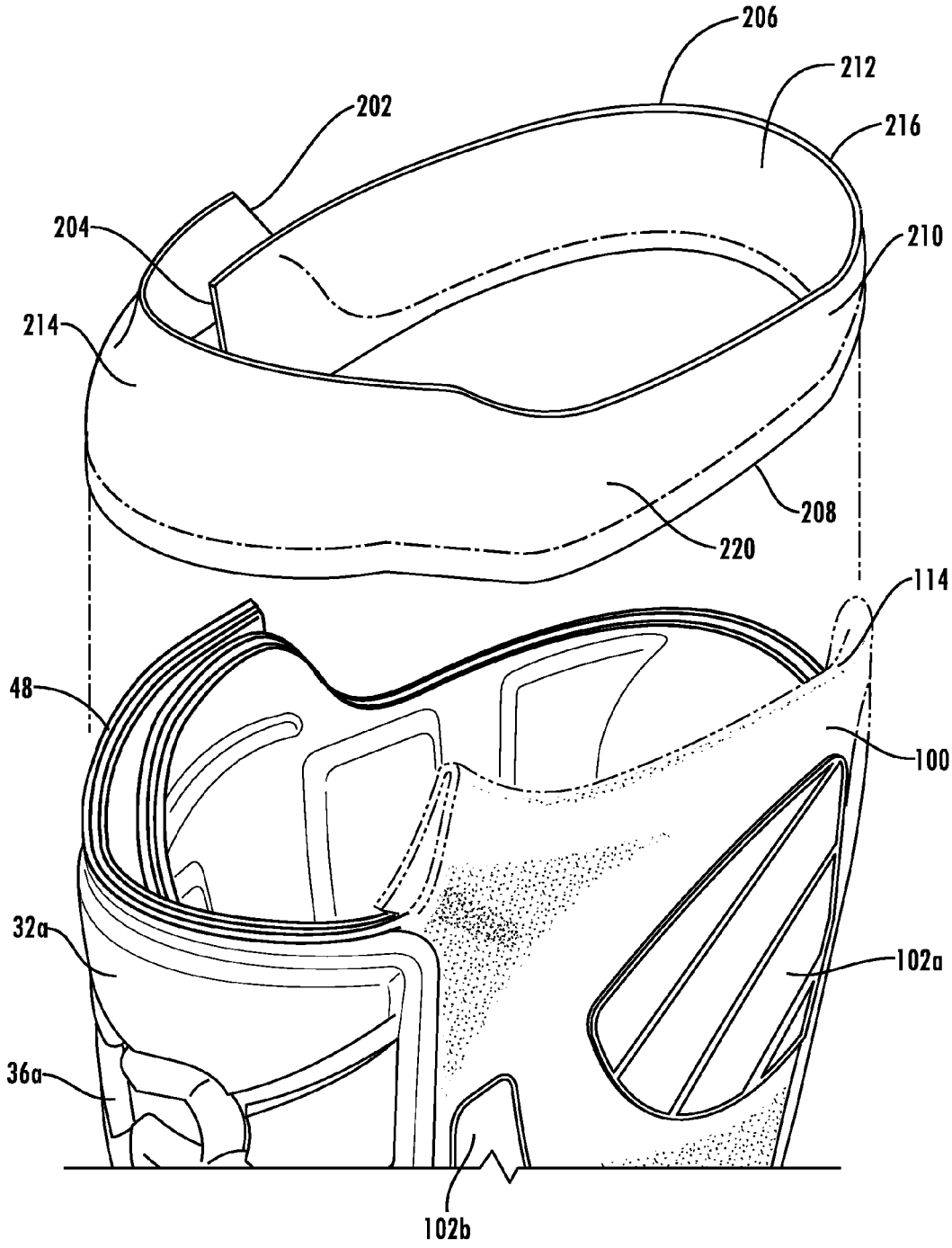
FIG. 5 is an exploded perspective view and close-up of the molded top gasket and fold-over burn-guard illustrated in FIG. 1.
Figure 6:
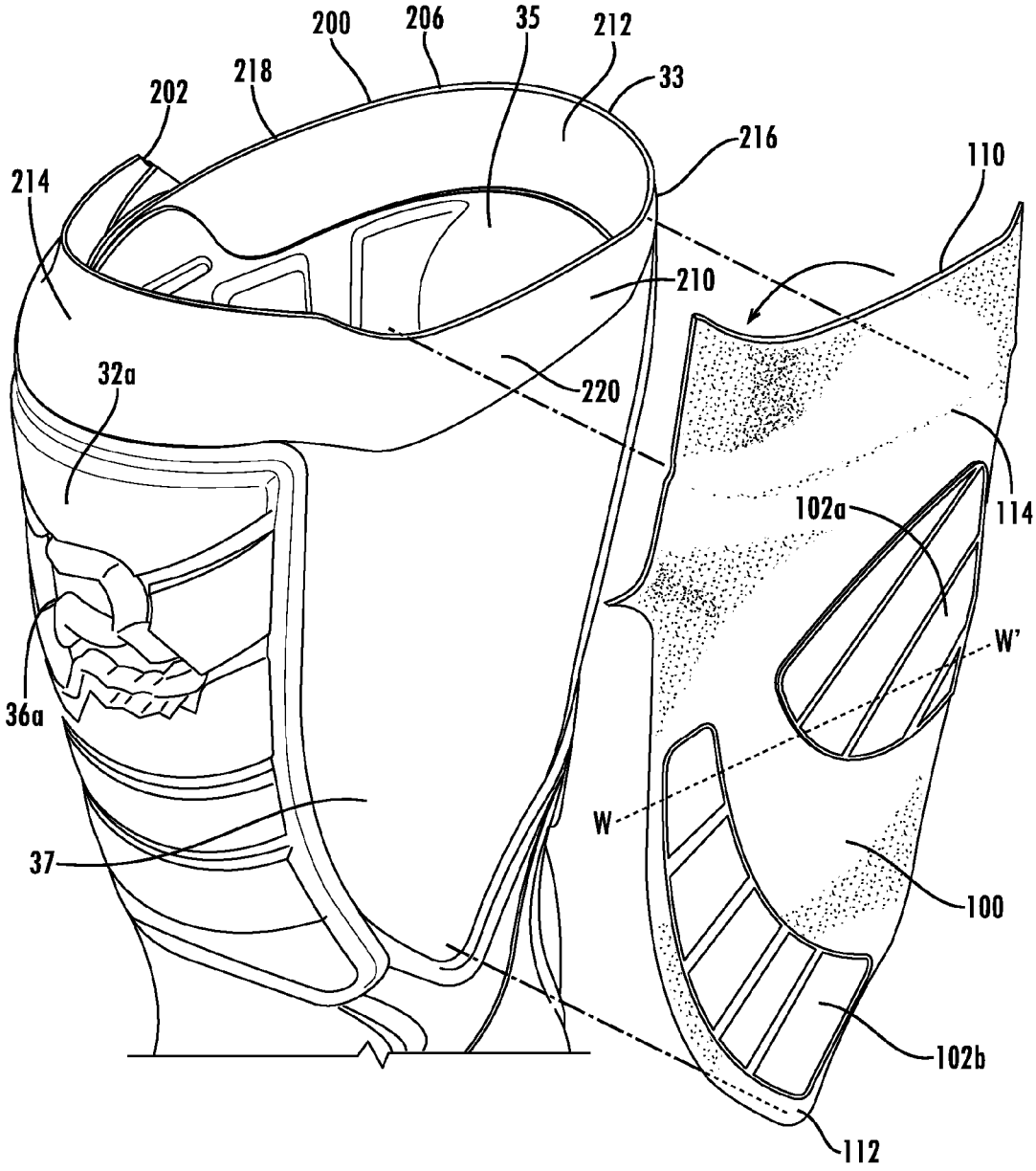
FIG. 6 is another exploded perspective view similar to FIG. 5 illustrating the structural relationship between the molded top gasket and the fold-over thermal laminate according to the inventive subject matter disclosed herein.
Figure 7:
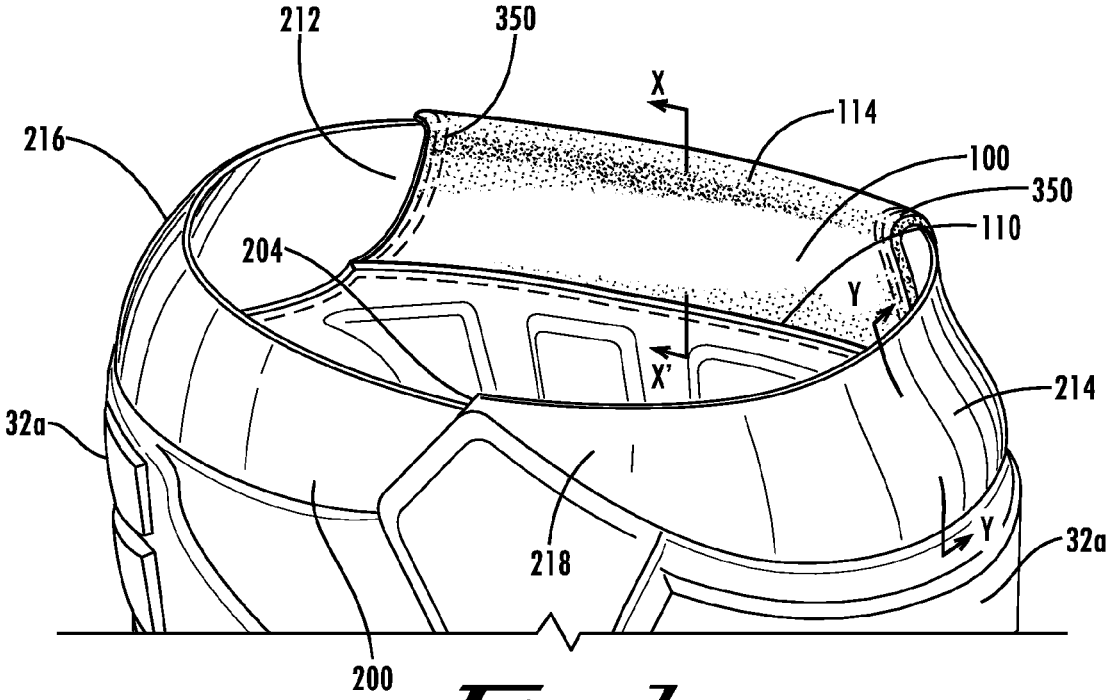
FIG. 7 is an right, front perspective view showing a close-up of the interior of the boot further illustrating the structural relationship between the molded top gasket and the fold-over thermal laminate.

In the illustrated embodiment (see esp. FIGS. 5-7), the molded top gasket 200 is a semi-annular, unitary piece made from an elastomeric material. The illustrated gasket 200 is "semi-annular" (rather than truly "annular") because it is not a fully continuous ring, it is an open ring having a first end 202 and a second end 204. The ends may be adapted to overlap each other when the boot is worn, or they may be adapted to be separated by a gap, or they may do either, depending on the girth of a specific wearer's leg. In any case, where there is a top gasket that is adapted to encircle at least half of a wearer's leg, the gasket is one that is "substantially annular". In other embodiments, the gasket may be a fully annular piece, an arcuately elongated member, or any other shape intended to fit against or around a portion of a wearer's lower leg. Additionally, the gasket may be a multi-piece construction, rather than a unitary piece.

Figure 8:
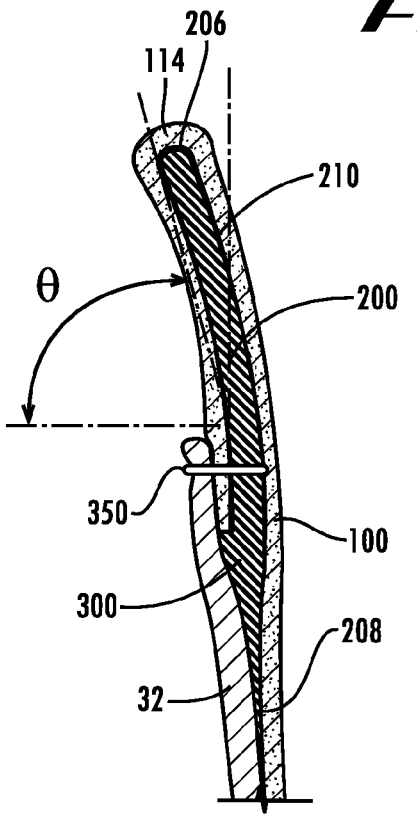
FIG. 8 is a cross-section of the structural relationship seen in FIG. 7. This cross-section is taken through line X-X' (on the lateral side of the boot) in FIG. 7.

Gasket 200 also has a top edge 206 and a bottom edge 208 with a complex curvature when seen in cross-section, as shown in FIG. 8. The top gasket 200 may have a substantially uniform thickness throughout, or the thickness may vary among different parts of the gasket. For example, a gasket may have a greater thickness at the base that gradually becomes thinner toward the top, or it may be thicker at the front of the boot and gradually diminish to a thinner profile at the rear of the boot. In the illustrated embodiment, the gasket 200 is about 5 to 7 mm thick at the base and about 1.0 to 1.5 mm thick at the top along line Y-Y'. A thicker base allows better integration with other components of the boot upper, while a thinner top induces more pliability in the regions more closely surrounding the wearer's leg.

Gasket 200 may be manufactured using an injection molding process that forms a three-dimensional, unitary piece suitable for construction of the overall boot without further modification. Injection molding offers an advantage over traditional gasket construction methods that form the gasket from sheet stock materials. These traditional methods often are limited to producing gaskets with simple curves, while injection molding easily allows manufacture of a molded top gasket with complex curves, which allow for certain advantageous characteristics described in more detail below. However, the gasket may be constructed or manufactured using other methods. For example, the gasket could be injection molded as an annular piece (i.e., a continuous, unbroken ring) and then cut, or it could be pressed as a flat sheet that is then folded onto itself and formed into a ring. The piece need not be formed of a single material, but may be formed from a blended material or a plurality of materials stitched, glued, bonded, fused, or otherwise attached or molded together.

Regardless of how it may be manufactured, gasket 200 completely, substantially, or partially encircles part of the wearer's leg substantially parallel to a transverse plane through the wearer's leg. In some embodiments, the gasket 200 is positioned to entirely or substantially encircle part of the wearer's leg when the boot is worn; the transverse plane of the gasket is substantially oriented to pass through a portion of the wearer's tibia and fibula inferior to the knee joint and superior to the ankle joint, such as through the superior half of the tibia and fibula in the lower leg. In other words, when the boot is worn, these embodiments of the gasket circumferentially surround a portion of the wearer's leg that includes a portion of the calf muscle.

The dimensions of the molded top gasket 200 may vary according to the size and intended use of the boot, desired comfort of the wearer, and other considerations. In the following discussion, the example dimensions are for a men's size 9 boot. In some embodiments, the height of the gasket (the distance between top edge 206 and bottom edge 208) is dimensioned to provide sufficient surface area for attaching the gasket to a boot upper. However, as described in further detail below, this surface area may not be a consideration if the gasket is manufactured as part of the boot upper, such as being co-molded with the impact shield of the upper, for example. In typical embodiments, the gasket may extend from about 1 mm to about 100 mm above the impact shield (or other portion of the upper to which it may be attached). In the illustrated embodiment, gasket 200 has an overall height of about 45 mm and extends about 33 mm above the impact shield; and there is an attachment flange of about 10-12 mm against the boot upper.

The molded top gasket may vary in thickness from about 1 mm to about 50 mm. As stated herein, the gasket may be of a substantially uniform thickness along its entire length or circumference, or the thickness may vary across portions of the gasket. For example, selected embodiments of the gasket have a greater thickness of material at the front to provide greater cushioning as the top front edge of the upper presses into or rubs against the superior-anterior portion of the wearer's shin.

The length or circumference of the gasket may be tailored to fit the size of the boot and/or the girth of the wearer's leg. In most embodiments, the gasket has a length or circumference of from about 10 cm to about 125 cm. For example, gasket 200 in the illustrated embodiment has a length of about 50 cm from first end 202 to second end 204 around the circumference of the top of boot upper 30.

The gasket may also have an angle of extension (θ) that may be determined by taking a cross-section through the gasket at one location along its length or circumference and measuring the angle of extension from a transverse plane. This angle of extension may vary from about 0 to at least about 90 degrees, and it may be consistent or it may vary between the top and bottom of the gasket. For example, the portion of gasket 200 illustrated in FIG. 8 has a varying angle of extension that imparts a slight inward curve to the gasket, and the portion of the gasket 200 illustrated in FIG. 9 has a varying angle of extension that imparts a complex S-curve shape. In both cases the angle of extension is less than 90 degrees relative to a top edge of the upper so that the gasket is bending inwardly from the top edge towards a wearer's leg. The varying thickness and curvature of the gasket allows the gasket to have customized properties that include curvatures, such as the radiused or s-shaped curvatures shown in FIGS. 8-9 for biasing the gasket against the leg for better seal; thinner profile at top of gasket relative to a base portion for elasticity or pliability for fit; thicker base portion for better attachment and/or protectiveness. The varying shapes and dimensions can be achieved using elastomeric materials in three dimensional molding processes, such as injection molding.

In other embodiments, an annular or semi-annular gasket may have a smaller diameter at its top than at its base that imparts a simple curve, or a consistent angle of extension in a gasket that has a substantially linear profile when seen in cross-section. The angle of extension can vary along the length of the gasket as well (i.e., the shape of one cross-section at one location on the gasket can be substantially different than another cross-section through the same gasket).

Additionally, the dimensions of the molded top gasket may be adjusted to accommodate a wearer's use of additional protective equipment. As just one example, some motocross riders desire additional leg protection in the form of a knee guard or a shin guard, and a portion of such a guard may extend down inside a motocross boot when the boot is worn. A gasket with a larger height may provide greater surface for contacting and frictionally retaining the outer surface of such a guard, while a gasket with a greater thickness may provide greater tensile strength and contraction force around the wearer's leg to hold the knee guard or shin guard in place within the boot and minimize its shifting or movement.

A gasket may be manufactured from a single elastomeric material or any suitable combination of elastomeric materials, including all of the materials recited herein. Typically, the gasket will have a hardness rating of from about 30 to about 70 Shore A Durometer.

The gasket may be made from any suitable manufacturing process. In particular embodiments, the gasket is manufactured by an injection molding process employing a three-dimensional mold. Injection molding is a well-known manufacturing technique for making parts from a plastic or elastomeric material. Source material is heated and injected into a three-dimensional mold under pressure. The mold may be precision-machined from metal (usually steel or aluminum) to form the desired dimensions and conformation of the manufactured part. In many cases, an injection-molded part requires no further modification or manipulation before being used to manufacture a device. However, in other cases, the injection-molded part may be polished, scored, painted, reheated, or otherwise worked, processed, or modified before it is used to manufacture a device. Specific injection molding processes and techniques are described in *Injection Molding Handbook*, Tim A. Osswald, Lih-Sheng Turng, and Paul J. Gramann, editors (Hanser Gardner Publications, October 2001, ISBN 1569903182) and John P. Beaumont, R. Nagel, and R. Sherman, *Successful Injection Molding: Process, Design, and Simulation,* 1st Edition (Hanser Gardner Publications, July 2002, ISBN 1569902917).

The gasket 200 shown in FIG. 5 has been manufactured separately from the upper 30 of the motocross boot 10. The gasket 200 may be added, mounted on, or coupled to the boot upper 30 during manufacturing of the boot 10 by stitching the gasket 200 into the upper 30 with high-strength thread, or by using an glue, cement, bonding agent, or other adhesive to provide a stitchless and seamless attachment, or any combination of the foregoing. Of course, the gasket also may be stitched into the boot upper using a suitable thread, and combinations of these attachments may be used. For example, both stitching and a contact cement could be used to attach the gasket to the upper.

However, in other embodiments, the gasket is co-molded with a part of the boot upper to form a single, fully physically integrated part. Co-molding (sometimes called "2K molding" or "double-shot injection molding") is a type of injection molding process where two or more materials are molded together in the same mold to manufacture a co-molded part. Insert over-molding is a particular type of co-molding process where one or more pieces are injected molded separately then molded with another piece in another injection molding process.

A co-molding process, including an insert over-molding process, may offer some advantages over other injection molding techniques, such as eliminating extra product handling, tooling, and other labor costs and reducing costs associated with inventory overhead. Furthermore, the materials used to form a co-molded part often create stronger physical and chemical bonds with each other than would otherwise be accomplished if the materials were separately injected molded together and then attached to each other through glue, bonding agent, or some other adhesive. For example (and without limitation), the top rim 48 of the impact shield 32 (i.e., the upper-most edge of impact shield area 32*a*) may be co-molded with the bottom edge 208 of gasket 200. This co-molding process would create a unitary piece that could be combined with other parts of the boot upper during manufacturing.

FIGS. 6-9 illustrate the top of upper 30 including the opening 31 for receiving a wearer's foot and the top edge 33 of the upper. In this embodiment, the top edge of the upper 33 corresponds to a portion of the top edge 206 of the gasket 200 and a portion of the thermal laminate 100. FIG. 6 shows the gasket 200 attached to the top portion of the impact shield 32 of the upper 30. The thermal laminate 100, with optional control pads 102*a-b*, is shown apart from the upper 30. The illustrated thermal laminate (shown in FIGS. 6-8) is attached to the upper 30 in a manner where a portion of the thermal laminate 100 is attached to the outer surface of the impact shield 32 and to the outer surface 210 of the gasket 200, is folded over the top edge 206 of the gasket 200, and is then attached to the inner surface 212 of the gasket 200. The thermal laminate 100 may be attached to the impact shield and gasket (and other portions of the upper if necessary or desired) by stitching as shown, or by glue, bonding agent, or some other adhesive.

Figure 9:
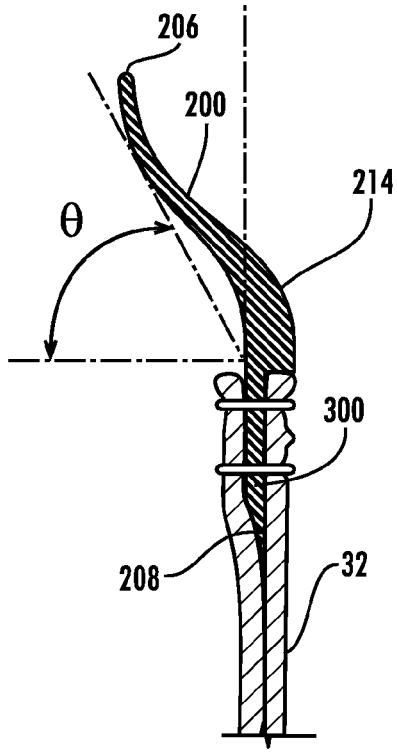
FIG. 9 is a cross-section of the structural relationship seen in FIG. 7. This cross-section is taken through line Y-Y' (on the front of the boot) in FIG. 7.

FIGS. 8 and 9 in particular illustrate the interface 300 between the gasket 200 and the impact shield 32 of upper 30 and the arrangement of the thermal laminate 100 with this construct. In this illustrated embodiment, the interface 300 is an adhesive bond between the two parts. However, in other embodiments, the interface 300 is a physically continuous segment accomplished by co-molding the top gasket 200 with the impact shield 32. The thermal laminate 100 may be held in place by stitching 350, although adhesive also could be used to secure the thermal laminate 100 to the top gasket 200 and the plastic impact shield 32.

As recited herein, gasket 200 may be used during manufacture of protective footwear, such as the motocross boot illustrated in FIGS. 1-4 and described above. Methods of manufacturing protective footwear are known and may vary considerably. Generally speaking, such a method includes the following steps (which may be accomplished in almost any desired order):

1. providing a sole unit 10;
2. providing an upper 30 that is characterized by: (1) at least a portion of the upper 30 formed from a impact shield portion 32 manufactured by molding a thermoplastic material; and (2) the upper 30 extends at least above the ankle of a wearer;
3. providing a substantially annular gasket 200 (as described above);
4. attaching the gasket to the upper; and
5. attaching the upper 30 to the sole unit 10.

The term "providing" is a non-limiting term meant to encompass any acquisition of a part, such as manufacturing the part or obtaining the part from third-party vendor or supplier. In particular embodiments of this manufacturing method, the gasket 200 is attached to the upper portion 32*a* of the impact shield 32. As stated above, the gasket may be adhesively attached to the upper or co-molded with the upper.

Fold-Over Thermal Laminate

FIGS. 5-7 illustrate one embodiment of the fold-over thermal laminate 100, which includes two optional control pads 102*a-b*. The thermal laminate 100 may be the outermost layer or structure of the upper 30 (thus becoming part of the outer surface 35 of the upper), it may be the innermost layer or structure of the upper 30 (thus becoming part of the inner surface 37 of the upper), or it may be sandwiched between other layers or structures of the upper. In particular embodiments, however, such as the embodiment illustrated in FIGS. 4-7, the thermal laminate 100 functions as part of the outer surface 35 of the upper 30, extends over a portion of the rim 33 of the upper 30 (thus forming the top-most or outer-most part of the rim), and becomes part of the inner surface 37 of the upper 30.

The thermal laminate 100 illustrated in FIGS. 4-7 is a continuous, unbroken, unitary piece, but in other embodiments, the thermal laminate is a non-continuous, non-unitary piece. For example, the thermal laminate may include one or more perforations or holes cut through its entire thickness, or one or more surfaces of the thermal laminate may be textured with channels, divots, shallow cut-outs, or the like. Additionally, the thermal laminate may be a multi-piece assembly, rather than being formed from a unitary piece of material. In such embodiments, the multiple pieces of the thermal laminate may be stitched, glued, or otherwise joined together, or the thermal laminate may be formed from pieces separated from one another by at least a small distance. For example, an alternative embodiment of the illustrated thermal laminate 100 may be formed from two pieces separated along line W-W'.

The thermal laminate 100 may be made of any suitable heat-resistant material that blocks, impedes, or otherwise reduces the transfer of heat through the material, including the specific materials mentioned herein. Optionally, the thermal laminate may be treated with a heat-resistant or flame retardant additive, such as platinum compounds, carbon black, aluminium trihydrate, zinc, or ceric compounds. It is generally desirable for the thermal laminate to have some flexibility or softness so that a wearer of a boot has tactile communication with the motorcycle or other motor vehicle, thereby helping the rider to achieve better control over the vehicle.

In the illustrated embodiment, thermal laminate 100 is configured with a tapered shape, similar to a flat, inverted triangle. Upper (first) end 110 of thermal laminate 100 forms the base of the substantially triangular shape and lower (second) end 112 forms the point closer to the distal sole of the boot. The portion of the thermal laminate 100 adjacent the upper end 110 is broader to provide greater coverage where, for example, the wearer is more likely to contact the motorcycle. However, the thermal laminate 100 is not limited to this tapered shape or orientation, and it may be configured to protect any surface or portion of the boot where such protection is desired.

In other embodiments, the thermal laminate may have a similar triangular conformation oriented in a different direction (rather than pointing downwards toward the distal sole of the boot), or the thermal laminate has a completely different shape, such as a square, circular, arcuate, trapezoidal, rectangular, oval, parabolic, any type of regular or irregular polygon, or any combination thereof. For example, the thermal laminate could be shaped as two overlapping circles or ovals, a few irregular triangles connected at their points, two differently sized rectangles joined in an "L-shape," or an "S-shaped" curve. In short, the conformation and dimensions of the thermal laminate are limited only by considerations such as (but not limited to): the overall size of the boot having the thermal laminate as part of the upper; the areas of the boot intended to be protected by the thermal laminate; the intended uses of the boot; aesthetic or product design requirements; or product branding desires.

Continuing with the example of a size nine men's boot, the thermal laminate 100 may be about 41.5 cm long (measured from the distal point 112 of the triangle along the Y-axis of the boot), about 22 cm wide at the base of upper end 110, and about 10.5 cm wide measured along line W-W'. The overall boot 10 may be about 41.5 cm high (measured from the bottom of sole unit 20 to the top of rim 33 defined by opening 31 of upper 20), about 45 cm in circumference around opening 31 of upper 20, about 48 cm in circumference around a line along the upper 30 defined by the transverse plane established by line W-W', and about 35 cm in circumference around a line along the upper 30 defined by the transverse plane established by the point of second end 112 of the thermal laminate 100. (All measurements are taken from the exterior surfaces of the boot.)

The embodiment illustrated in FIGS. 1-7 represents a motocross boot. In some embodiments, the dimensions of thermal laminate 100 vary proportionally with increasing or decreasing sizes of the overall boot. As just one example, the illustrated motocross boot could be sized for a child by reducing its overall dimensions by 40%, including the dimensions of the thermal laminate.

In the illustrated embodiment, the thermal laminate 100 may have a substantially uniform thickness of about 2 mm. The thickness of the thermal laminate may be substantially uniform across its entire area, or the thickness may vary across its entire area. For example, a thermal laminate may be thicker in places where greater protection is needed or desired.

Figure 4:
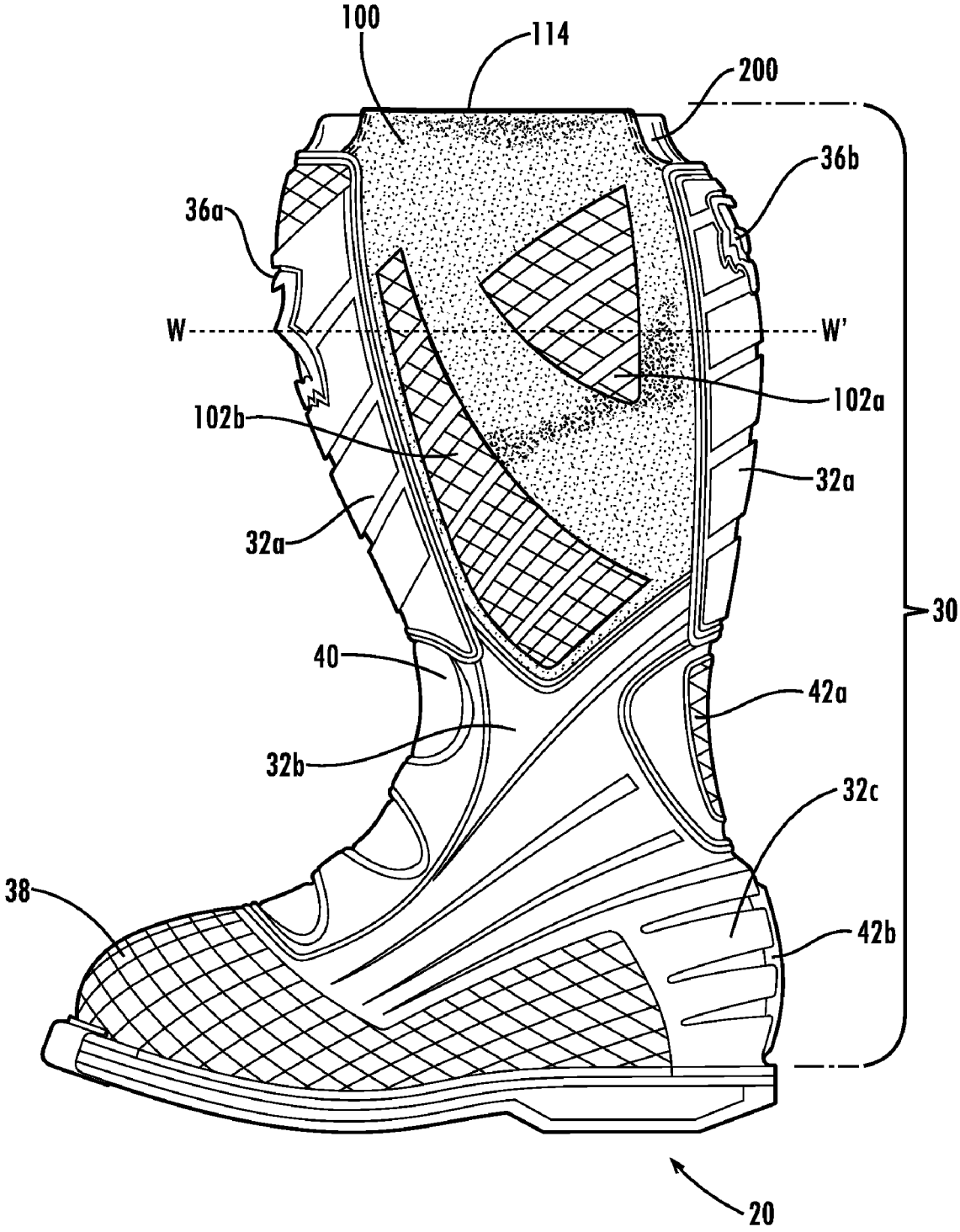
FIG. 4 is a left side view of the boot shown in FIG. 1.

As shown especially in FIGS. 4 and 5, thermal laminate 100 may substantially covers the medial portion of the impact shield 32, particularly the upper portion of the shield 32*a*, which could be made from a thermoplastic or other material that is vulnerable to heat damage. This placement allows the thermal laminate 100 to protect a medial portion of the wearer's lower leg (beneath the knee and above the ankle) when the boot is worn. In particular embodiments, the thermal laminate 100 covers a majority of the surface area of the medial part of the upper shield portion 32*a* and protects a substantial portion of—and even a majority of—the medial-superior half of the boot and the wearer's lower leg (as measured from the inferior edge of the knee join to the superior-most extension of the ankle joint). In other embodiments, the thermal laminate may cover less surface area of the upper shield portion 32*a* and/or only a minor portion of the medial-superior half of the boot and wearer's lower leg.

The thermal laminate 100 illustrated in FIG. 4 may substantially covers the medial side of the upper shield portion 32*a*, extending down into the medial side of middle shield portion 32*b*. However, the thermal laminate may cover more of the medial side of the boot. In some embodiments, the thermal laminate 100 may cover more surface area of the middle shield portion 32*b*, and may extend further down the medial side of the boot into lower shield portion 32*c*. In fact, the thermal laminate may extend to the top edge of the sole unit 20, or may even wrap around the edge of the sole unit 20 onto the bottom of the sole unit 20.

In any embodiment, the thermal laminate 100 may extend from the top of the upper 30 and fold over the top rim 33 of the upper 30 into the opening of the upper 31. In such an embodiment, thermal laminate 100 lies within at least a portion of the outer surface 35 of the upper 30, at least a portion of the rim 33 of the upper 30, and at least a portion of the inner surface 37 of the upper 30. The illustrated thermal laminate 100 provides just one example of this concept. As shown in FIGS. 5-7, the middle and lower portions of thermal laminate 100 (i.e., the portion closer to second end 112) are secured to the outer surface 35 of the upper 30. In particular, the middle and lower portions of thermal laminate 100 may be mounted to the upper portion 32 of the impact shield 32, and the upper end 110 of the thermal laminate 100 may be folded over the rim 33 of the upper 30 into the opening 31 of the upper. The upper end 110 may be folded over the top edge 206 of gasket 200 (which forms the rim 33 of the upper 30) and mounted to the inner surface 212 of gasket 200. In such embodiments, the fold 114 of the thermal laminate 100 thus lies on top or above the top edge 206 of gasket 200.

The thermal laminate may be secured to the boot by any desired or suitable means including (but not limited to) stitching, melting, co-molding, adhesive bonding, or any combination thereof. For example, the thermal laminate 100 illustrated in FIGS. 4-7 is adhesively bonded to the outside of the shield 32, and the outer surface 210, the inner surface 212, and the top edge 206 of the gasket 200. The thermal laminate 100 of the illustrated embodiment is further secured by stitching 350.

The thermal laminate optionally may include one or more control pads for frictionally engaging a motorcycle (or other vehicle) and facilitating control of it during operation. In the illustrated embodiment, the thermal laminate 100 includes two control pads 102*a* and 102*b*, but in alternative embodiments, the thermal laminate includes a different number of control pads. In fact, the number of control pads placed on the thermal laminate is limited only by the desires or objectives of a manufacturer, intended uses of the boot (or other protective footwear), production costs, public demand, or any other relevant consideration.

The shape and dimensions of a control pad also vary according to similar considerations as those describe above. The illustrated embodiment includes a control pad 102*a* with a substantially triangular shape and another control pad 102*b* with a swooping, arcuate shape. The shape and dimensions may be tailored to meet aesthetic design requirements as well as functional considerations. For example, as shown in FIG. 4, the forward border of control pad 102*b* runs parallel to the forward edge of thermal laminate 100. Each of the illustrated control pads 102*a* and 102*b* may have a substantially uniform thickness of about 2-5 mm. However, any embodiment of the control pad may have a substantially uniform thickness, or a varying thickness across its area.

A control pad may be positioned anywhere on the outer surface of the boot or other protective footwear. In many embodiments, at least one control pad is attached or mounted to the outer surface of a thermal laminate or a portion of the thermal laminate. For example, a control pad may overlap a thermal laminate and another portion of the upper.

The control pad may be positioned to engage any part of the vehicle that the wearer's boot can reach while the wearer is riding. In particular embodiments, the control pads are disposed to engage targeted parts of a vehicle operated by the wearer of the footwear. For example, a motocross boot may have control pads disposed near the top of the boot to engage the frame, bodywork, engine, or exhaust system, and may have control pads disposed closer to the bottom of the boot intended to engage the lower frame or foot-peg of the bike. A rider may position her foot to engage the control pad with a part of the vehicle to directly control the motorcycle or to enhance the rider's sensory perceptions while riding. For example, a motocross rider may better feel engine vibrations through the motorcycle when pressing a control pad against the frame or exhaust system, or a rider may better control the motorcycle over jumps by maneuvering it with his legs and feet. Control pads are also desirable at high wear areas. FIG. 4 illustrates certain desirable locations of control pads. A control pad 102*a* is located at a meaty portion of the calf where there is a need for tactile control, wear resistance and/or more protection. Similarly control pad 102*b* includes an area of coverage corresponding to a wearer's ankle where there is a need for tactile control, wear resistance and/or more protection. A control pad also may extend upwardly along a front edge of the wearer's calf to provide such qualities.

In particular embodiments, the control pad is made from a natural or synthetic rubber or elastomer. More particularly, a control pad may be composed of silicone rubber compound, including fluorosilicone rubbers and high-temperature vulcanized rubbers. And, like the thermal laminate, the control pad can include a heat-resistant or flame retardant additive. Typically, the gasket will have a hardness rating of from about 30 to about 80 Shore A Durometer. Preferably a control pad for use with a motor vehicle such as a motorcycle should be capable of withstanding temperatures of about 400° F. or more.

Commercially available silicone rubbers suitable for use in making a control pad include the "Silastic® silicone rubbers commercially available from the Dow Corning Corporation (Midland, Mich., USA).

Explanation of Terms

The following explanations of terms are intended to supplement, but not contradict or contravene, their ordinary dictionary definitions. While some terms are described relative to a human or animal body, the same descriptive terms can be adapted for use with inanimate objects, such as the protective footwear described herein. For example, the medial side of a motocross boot is the side closest to the midline of a wearer's body when the boot is worn.

Anterior. When referring to the human body, "anterior" structures or objects are near the front of the body. For example, the nose is located on the anterior side of the head. "Anterior" also corresponds to the term "ventral" used in general vertebrate biology.

Coronal plane. When referring to vertebrate anatomy, the coronal plane divides the body into dorsal and ventral portions (or, when referring to human anatomy specifically, the coronal plane divides the body into anterior and posterior portions).

Deep. When referring to human or animal anatomy, the term "deep" (also equivalent to "profound" or "internal") refers to structures that are inside the human body away from the body surface. For example, the hypothalamus is a deep gland within the human head.

Distal. When referring to a human or animal body, "distal" refers to a point that is further away from the main body (as opposed to "proximal"). For example, after a fly fisherman has made a cast, he has cast the distal end of the fishing line away from him.

Inferior. When referring to human anatomy, parts of the body that are "inferior" are farther away from the head. For example, the ankle is inferior to the knee.

Lateral. Those structures near the sides of a human or other animal, and further away from the body's midline, are described as being "lateral" (as opposed to "medial"). For example, the human ears are lateral to the human eyes, and the "pinky toe" of the foot is the most lateral toe.

Medial. Those structures near or closest to the midline of a human or other animal, and further away from the body's outsides, are described as being "medial" (as opposed to "lateral"). For example, the human breast bone is medial to either shoulder blade, and the "big toe" of the foot is the most lateral toe.

Median plane. In vertebrate anatomy, the median plane passes between the top and the bottom of the body and separates the left and the right sides of the body in equal halves.

Posterior. When referring to the human body, "posterior" structures or objects are near the back of the body. For example, the spine runs through the posterior portion of the torso. "Posterior" also corresponds to the term "dorsal" used in general vertebrate biology.

Proximal. When referring to a human or animal body, "proximal" refers to a point that is closer to the main body (as opposed to "distal"). For example, a person holding the very end of a rope holds the proximal end of that rope.

Sagittal plane. In vertebrate anatomy, a sagittal plane divides the body into left and right portions. The midsagittal plane falls within the midline of the body and passes through midline structures such as the human navel or spine. All sagittal planes are considered parallel to the midsagitall plane.

Superficial. When referring to human or animal anatomy, the term "superficial" (or "external") refers to structures that are on or close to the body surface. For example, sweat glands occupy a superficial position on the human body within the skin.

Superior. When referring to human anatomy, parts of the body that are "superior" are closer to the head. For example, the collar bone is superior to the pelvis.

Transverse plane. Regarding vertebrate biology, the transverse plane divides the body into cranial and caudal portions (or, when referring to human anatomy specifically, the transverse plane divides the body into superior and inferior portions). When referring to inanimate objects, a transverse plane runs perpendicular (or substantially perpendicular) to a longitudinal axis of the object.

Unitary piece. A "unitary piece" or "unitary part" is a single-unit construction made from one material or a mixture of materials fused or meshed together (such as an alloy, a blended plastic, or a fabric woven from a plurality of threads or yarns). An injection molded part (including a single piece made by a co-molding process) is considered a "unitary piece." A part constructed by joining two manufactured pieces together—such as by gluing or adhesively bonding, stapling, stitching, riveting, welding, or the like—is not considered a "unitary piece." Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein. All patent literature and non-patent literature cited herein is hereby incorporated by reference as if recited in full herein for all purposes.

What is claimed:

1. An item of protective footwear, comprising:

a sole unit and an attached upper for receiving the foot and at least a calf portion of the leg of a wearer, the upper having a selected portion of a medial side padded with a thermal laminate comprising at least one layer of an insulating material that helps protect against heated components of a motor vehicle, the thermal laminate extending over a top edge of the upper and into an interior surface of the upper; and wherein the top edge of the upper comprises a top gasket and the thermal laminate extends over the top gasket.

2. The item of protective footwear according to claim 1, wherein the upper further comprises an impact shell and the top gasket is made of an elastomeric material that is softer than the material of the impact shell.

3. The item of protective footwear according to claim 1, wherein the process used to form the top gasket comprises an injection molding process.

4. The item of protective footwear according to claim 1, wherein the top gasket is a unitary piece.

5. The item of protective footwear according to claim 1, wherein the gasket is substantially annular in shape.

6. The item of protective footwear according to claim 1, wherein the top gasket is adapted to substantially encircle the wearer's leg around approximately the top portion of the wearer's calf below the knee.

7. An item of protective footwear, comprising:

a sole unit and an attached upper for receiving the foot and at least a calf portion of the leg of a wearer, the upper having a selected portion of a medial side padded with a thermal laminate comprising at least one layer of an insulating material that helps protect against heated components of a motor vehicle, the thermal laminate extending over a top edge of the upper and into an interior surface of the upper; and further comprising a plurality of spaced apart control pads disposed on the thermal laminate for frictionally engaging a motorcycle or other motor vehicle operated by the wearer.

8. The item of protective footwear according to claim 7, wherein at least one control pad is disposed on a region of the upper corresponding to a wearer's calf.

9. The item of protective footwear according to claim 7, wherein at least two control pads are disposed on the thermal laminate.

10. The item of protective footwear according to claim 9, wherein a control pad is disposed on the thermal laminate in a position corresponding to a meaty portion of a wearer's medial calf and a control pad is disposed on the thermal laminate in position corresponding to a wearer's ankle.

11. The item of protective footwear according to claim 7, wherein at least one control pad is heat resistant above about 400° F.

12. The item of protective footwear according to claim 11, wherein the control pad comprises a heat resistant natural, synthetic rubber or silicone rubber.

13. A method of manufacturing protective footwear, comprising:

providing a sole unit;

providing an upper for receiving the foot and at least a calf portion of the leg of a wearer, the upper having a selected portion of a medial side padded with a thermal laminate comprising at least one layer of an insulating material that helps protect against heated components of a motor vehicle, the thermal laminate extending over a top edge of the upper and into an interior surface of the upper;

attaching the upper to the sole unit; and wherein the top edge of the upper comprises a top gasket and the thermal laminate extends over the top gasket.

14. An item of protective footwear, comprising:

a sole unit and an attached upper, the upper being adapted to extend at least above the ankle of a wearer, a thermal laminate disposed on the upper and extending over a top edge of the upper and into an interior portion of the upper, and at least one control pad for frictionally engaging a motor vehicle disposed on the thermal laminate.

* * * * *